US008863335B2

(12) United States Patent
Shamaiengar

(10) Patent No.: US 8,863,335 B2
(45) **Date of Patent: *Oct. 21, 2014**

(54) NECK SUPPORT DEVICE

(71) Applicant: Ravi Shamaiengar, Williamsburg, VA (US)

(72) Inventor: Ravi Shamaiengar, Williamsburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/148,144

(22) Filed: Jan. 6, 2014

(65) Prior Publication Data

US 2014/0115788 A1 May 1, 2014

Related U.S. Application Data

(63) Continuation of application No. 13/524,509, filed on Jun. 15, 2012, now Pat. No. 8,646,135.

(51) Int. Cl.

| | |
|---|---|
| ***A47C 20/00*** | (2006.01) |
| ***A47G 9/10*** | (2006.01) |
| ***A47C 7/38*** | (2006.01) |

(52) U.S. Cl.

CPC ..... *A47G 9/1081* (2013.01); *A47C 7/383* (2013.01); *A47G 9/1009* (2013.01)

USPC ..... 5/640; 5/636; 5/637

(58) Field of Classification Search

CPC ... A47G 9/1009; A61G 13/121; A61G 13/12; A61G 7/072; A61G 7/065; A61G 7/07; A61G 13/1255; A61G 13/101; A61G 15/125; A61G 2200/54; A47C 7/383; A47C 7/38; A61F 5/3707; A61F 5/05883

USPC ..... 5/636, 640, 643

See application file for complete search history.

(56) References Cited

U.S. PATENT DOCUMENTS

| | | | | |
|---|---|---|---|---|
| 15,581 | A * | 8/1856 | Slaughter | 297/393 |
| 2,973,030 | A * | 2/1961 | Matthewson | 297/393 |
| 3,957,040 | A * | 5/1976 | Calabrese | 602/36 |
| 4,285,081 | A * | 8/1981 | Price | 5/637 |
| 4,708,129 | A * | 11/1987 | Pujals, Jr. | 602/18 |
| 5,242,377 | A * | 9/1993 | Boughner et al. | 602/17 |
| 5,411,471 | A * | 5/1995 | Terrazas | 602/18 |
| 5,974,607 | A * | 11/1999 | Smith | 5/636 |
| 6,308,345 | B1 * | 10/2001 | Williams, Jr. | 2/468 |
| 6,447,468 | B1 * | 9/2002 | Hankins et al. | 602/18 |
| 6,658,681 | B2 * | 12/2003 | Britto et al. | 5/655 |
| 6,786,554 | B1 * | 9/2004 | Zahiri | 297/393 |
| 6,893,094 | B2 * | 5/2005 | O'Connor | 297/397 |
| 7,093,903 | B2 * | 8/2006 | O'Connor et al. | 297/397 |

(Continued)

*Primary Examiner* — Robert G Santos
*Assistant Examiner* — Richard G Davis
(74) *Attorney, Agent, or Firm* — Brian J. Teague

(57) ABSTRACT

A neck support device comprises a flat, portable device comprised of a central malleable but supportive inner core or endoskeleton covered by a comfortable padded shell. The device shapes into a structure, supporting a user's head by translating the weight of the user' head to the user's shoulder, bypassing the neck, thus allowing relaxation of the supportive structures of the neck. The neck support device comprises a flexible and bendable inner core and an outer sheath material. Portions of the device may be bent into a support position by the user to support the user's head. The device may be bent into a substantially flat configuration for storage. The device may comprise contoured padding located for support or comfort and slip-resistant materials or surfaces. The device may translate the weight of the user's head from a head portion to a shoulder portion via a neck portion.

14 Claims, 4 Drawing Sheets

301

(56) References Cited

U.S. PATENT DOCUMENTS

| | | | | |
|---|---|---|---|---|
| 7,197,781 | B2 * | 4/2007 | Ramsbottom et al. | 5/636 |
| 7,908,692 | B2 * | 3/2011 | Lange | 5/636 |
| 8,141,187 | B2 * | 3/2012 | Schwingendorf et al. | 5/636 |
| 8,418,293 | B2 * | 4/2013 | Tansingco | 5/636 |
| 8,468,629 | B2 * | 6/2013 | Beevers et al. | 5/655 |
| 2005/0102758 | A1 * | 5/2005 | Ramsbottom et al. | 5/636 |
| 2005/0179300 | A1 * | 8/2005 | O'Connor et al. | 297/391 |
| 2010/0147313 | A1 * | 6/2010 | Albrecht | 128/845 |

* cited by examiner

301

NECK SUPPORT DEVICE

CROSS-REFERENCE TO RELATED APPLICATIONS

This application is a continuation of and claims priority to pending U.S. application Ser. No. 13/524,509, filed Jun. 15, 2012, the contents of which are incorporated herein by reference in its entirety.

FIELD OF THE INVENTION

This invention relates to neck support devices.

BACKGROUND

The human spine comprises several regions. The cervical region corresponds to the neck and has a natural curvature. This curvature is lordotic, meaning that it is concave dorsally. The cervical lordotic curve is also known as a "C" curve. Positioning the head in a perpendicularly to the shoulders helps maintain a healthy C curve. Bending the cervical spine, especially for prolonged periods, is considered poor posture. Poor posture can lead to negative health and wellness effects, the more minor of which may include headaches, discomfort, muscle cramps, neck pain, and shoulder pain. Maintaining proper posture is often difficult during certain activities, such as, for example, resting, reading, watching television or movies, using a computer, traveling on an airplane or in a vehicle, or remaining in a static position for a prolonged period. Though muscles can help stabilize the cervical spine, they sometimes have a reduced capacity to do so, such as during sleep or rest, or as a result of muscular conditions (e.g., atrophy). As an example, an airplane traveler may wish to sleep or rest on a long flight, but may be restricted to the seated position. In this example, the traveler may experience difficulty finding a comfortable position or may experience negative effects as a result of improper neck positioning during sleep or rest. Thus, there is a need for a device that helps maintain proper neck posture.

Currently, there are numerous neck support items available. The two primary types of neck-specific pillows include a neck collar shaped like a horseshoe and a cervical neck pillow. Each offers specific attention to the neck, while providing support in different ways. The horseshoe collar is intended for use while seated. The cervical neck pillow is intended for use while prone and provides a contoured pillow with a cradle for the head. Other neck support devices are found to be flimsy, insufficiently supportive, and uncomfortable. Thus, there is a need for a neck support device which is not flimsy, but is supportive and comfortable.

None of these neck support items is adjustable and customizable for the user's comfort and support. Instead, the items provide a one-size-fits-all solution. For example, a horseshoe collar is not adjustable for the length of the user's neck or desired position of support. Neither is the point of support adjustable; the horseshoe collar provides support principally along the jaw and base of the skull. If the user prefers to choose the location of support, the existing devices are inadequate. Thus, there is a need for an adjustable, customizable, and supportive neck support item.

Further, none of the neck support items available is easily collapsible or packable. Such a concern is especially relevant to those who use such devices while traveling. Contoured pillows often contain foams or stiff filling that resists compression. Horseshoe collars have similar problems. While some horseshoe collars comprise an inflatable bladder, such devices entail problems of their own. For example, users with a reduced lung capacity or reduced lung health may have difficulty inflating such devices. Further, the process of inflating and deflating the devices is an inconvenient step that reduces the collapsibility and packability of the device. Thus, there is a need for a portable, collapsible, or packable neck support item.

Neither horseshoe collars nor cervical neck collars provide support in the forward direction. That is, neither type of neck support item prevents the user's head from tilting forward, which may happen naturally such as during sleep while seated. Similarly, the user's head is prone to wobbling. Thus, there is a need for a neck support item that prevents the user's head from unintentionally tilting forward or wobbling.

The above problems, and others, are reduced by the invention as herein described and shown.

BRIEF SUMMARY

The above problems, and others, are reduced, according to exemplary embodiments, by the neck support device.

According to an exemplary embodiment, a neck supporting device comprises a bendable, padded disk lined on one side. Portions of the disk are incompletely separated from other portions of the disk by cuts in the material of the disk. Each portion is joined to one or more adjacent portions at edges. A user may bend the disk at the edges and may also bend the disk within each portion. The disk comprises three portions: a head portion, a neck portion, and a shoulder portion. The user bends the head portion until it is contoured to cradle the head. The user bends the shoulder portion until it is contoured to rest on the user's shoulder. The user will then position the neck portion against the side of the user's neck. The weight of the user's head will exert force upon the head portion, which weight will be translated via the neck portion to the shoulder portion, where it is in turn translated to the user's shoulder. Thus, the weight of the user's head is relieved from the user's neck, while the device facilitates proper positioning of the user's cervical spine. Multiple such neck supporting devices may be worn on opposing sides of the head, thereby translating the force exerted by the weight of the user's head to one or both of the user's shoulders.

According to an exemplary embodiment, the head portion of the neck supporting device comprises padding such as foam or discrete pads. The padding may be homogenously distributed on the head portion, may be heterogeneously distributed, or may be contoured to provide added support in particular areas. For example, additional padding may be provided to support the distal aspects of the mandibular bodies and mentum (chin), referred to as the mental protuberance (hereinafter the "MEP"). A second comfort pad may be positioned on the head portion at a location configured to support the angles of the mandible (hereinafter the "MA"). A third comfort pad may be positioned on the head portion at a location configured to support the mastoid processes (hereinafter the "MAP") posterior to the ear. A fourth comfort pad may be positioned on the head portion at a location configured to support the skull base and, specifically, the occipital protuberance (hereinafter the "OP") at the posterior skull base of the wearer.

An object of the invention is to provide a device to support the neck and head of a user while traveling. The device comprises an inner core which, when unbent, is flat and provides a thin profile for compact storage. When the user desires to use the device, the user can bend the inner core to a particular shape. The nature of the material of the inner core allows the user to bend the inner core with manual power alone, without the use of tools. However, it retains the shape once bent and is resistant to bending sufficiently to bear the weight of the user's head without unintentionally deforming.

Other devices, methods, and/or products according to embodiments will be or will become apparent to one of ordinary skill in the art upon review of the following drawings and further description. It is intended that all such additional devices, methods, and/or products be included within this description, be within the scope of the present invention, and be protected by the accompanying claims.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
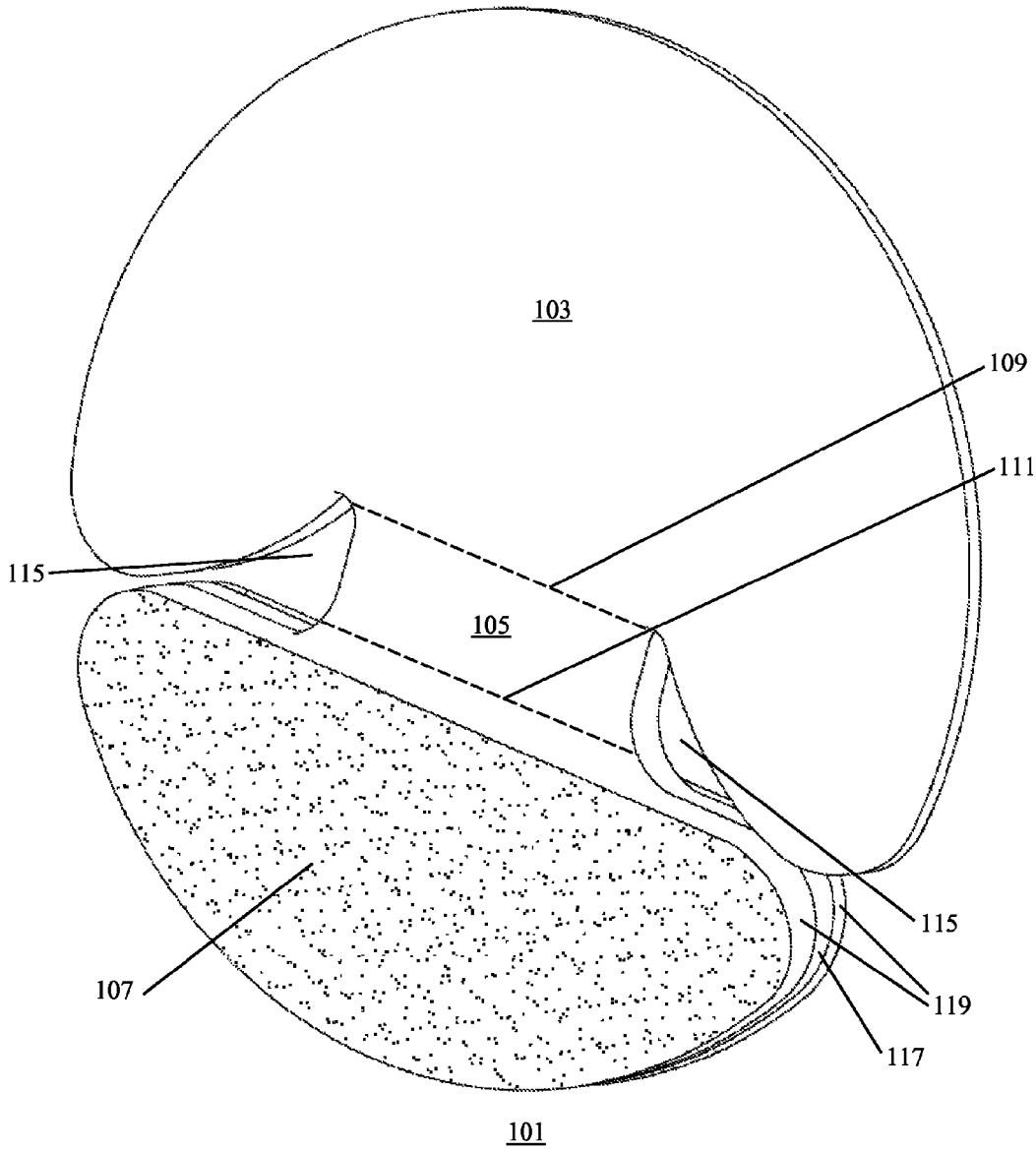
FIG. 1 is a perspective view of an embodiment of the present invention.

FIG. 1 depicts a perspective view of an embodiment of the present invention. The neck support device 101 comprises a head portion 103, a neck portion 105, and a shoulder portion 107. Head portion 103 and neck portion 105 join at top edge 109. Neck portion 105 and shoulder portion 107 join at bottom edge 111. The outer perimeter of the neck supporting device 101 may be roughly and irregularly circular or ovoid. The outer perimeter is made more irregular by cut lines 115, which help define head portion 103, neck portion 105, and shoulder portion 107. In some embodiments, the head portion 103 may directly or nearly contact the shoulder portion 107. In other embodiments, cut lines 115 may be broad such that the head portion 103 cannot contact the shoulder portion 107 when the inner core 117 is unbent. However, the cut lines 115 transect the neck support device, but such transection is incomplete at least to the extent of the width of the neck portion 105.

The neck support device 101 comprises an inner core 117. The inner core 117 comprises a bendable, pliable, or flexible material, such as, for example, a soft-temper metal. Such material may be, for example, steel, steel alloy, aluminum, or aluminum alloy that is of a stiffness that requires only moderate force to bend the core into a particular shape, yet preserves that shape once assumed. The core should bend easily enough for the user to be able to do so manually and without mechanical assistance, but resistant enough to avoid unintentional deformation, such as by the weight of the user's head on the head portion 103 when the device is in use. Within this range, the exact stiffness of the core or the exact amount of force required to shape it is immaterial. Further, the stiffness of the inner core 117 may be heterogeneous, particularly among the portions and edges. For example, the neck portion 105 may be stiffer than the head portion 103 or the shoulder portion 107. As a further example, the inner core 117 may be more or less stiff at both of or either the top edge 109 or bottom edge 111 compared to elsewhere on the inner core 117. The inner core is bendable, moldable, or shapeable, and those terms may be used interchangeably to describe the characteristics of the inner core.

Further, mixed materials may be used throughout the inner core 117. For example, some areas may be more frequently bent than others, in which case those frequently-bent areas may benefit more than the others from the use of material more resistant to metal fatigue. If top edge 109 or bottom edge 111 may be subject to more frequent bending than, e.g., the neck portion 105. Other areas may benefit from stiffer, less flexible materials. Such variations in stiffness may be accomplished by variations in the type of material used, the treatment or preparation of the material used, or the thickness or amount of material used.

Around and substantially encompassing the inner core 117 is the outer sheath material 119. The outer sheath material 119 may completely encompass and enclose the inner core 117. Conversely, the outer sheath material 119 may partially enclose the inner core 117, for example by leaving the edges of the inner core 117 exposed as in FIG. 1. For an example of an embodiment with full enclosure, see FIG. 3, FIG. 4, and the accompanying discussion.

The outer sheath material 119 may comprise any of various types of padding, foam, cloth, fabric, or other flexible material. The outer sheath material 119 encompasses the head portion 103, neck portion 105, and shoulder portion 107 of the neck support device 101. In an embodiment, the portion of the outer sheath material 119 encompassing the shoulder portion 107 comprises a gripping surface 113. The gripping surface 113 helps prevent the neck support device 101 from slipping from the shoulder of the user when the neck support device is bent into its support shape. (See FIG. 3, FIG. 4, and the related discussions.)

Figure 2:
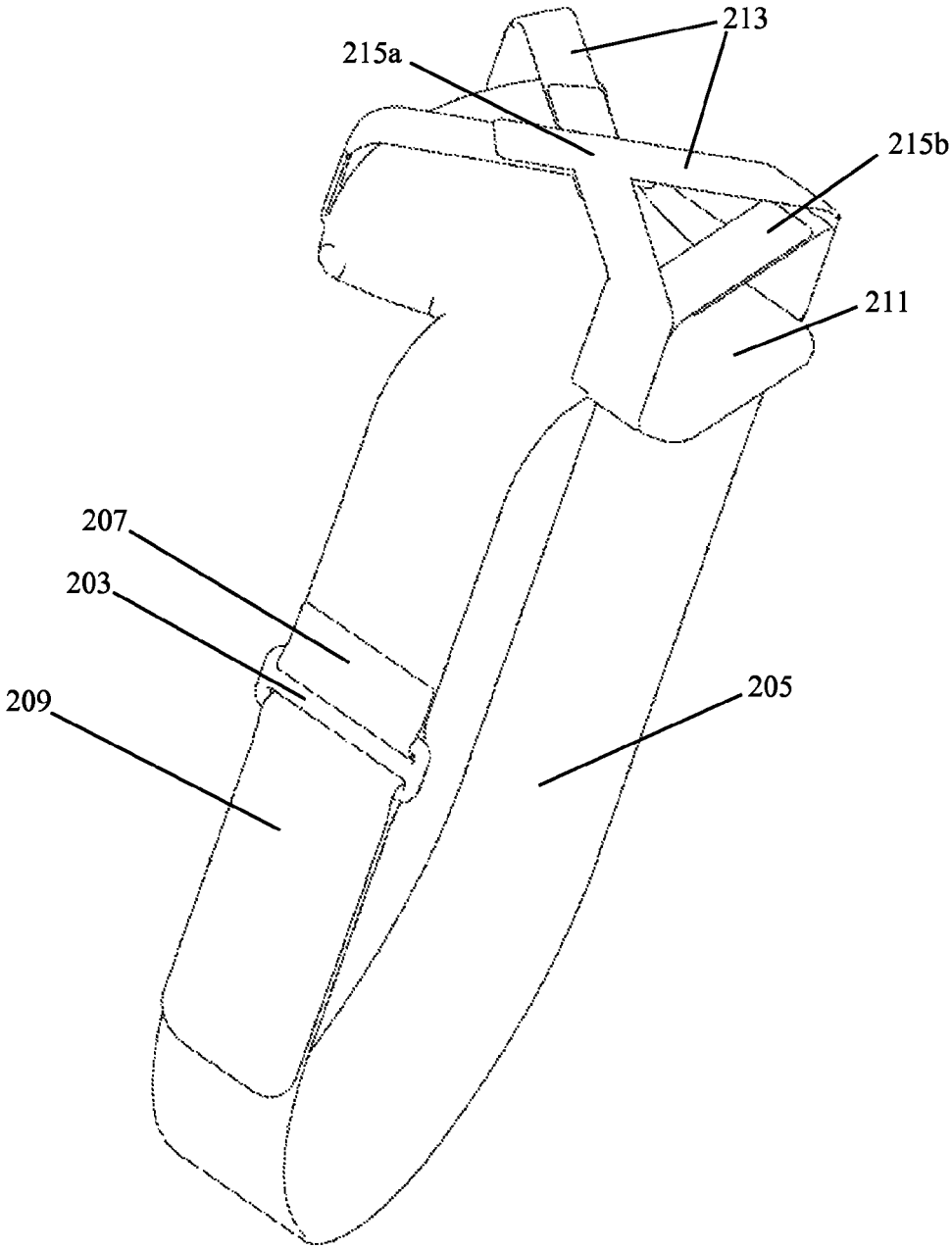
FIG. 2 is a perspective view of an aspect of the present invention.

FIG. 2 depicts a perspective view of an aspect of the present invention. In an embodiment, the invention includes a shoulder strap 201. The shoulder strap 201 is configured to help retain the neck support device upon a user's shoulder. The shoulder strap 201 comprises a belt 205, a paddle 211, and a harness 213. The belt 205 comprises a first belt portion 217 and a second belt portion 219 joined by a buckle 203. The strap 205 is configured to encompass a user's body (not shown) with the belt 205 passing under an arm and the paddle 211 positioned upon the top of the opposite shoulder. The second belt portion 219 comprises an adjustment region 209, which partially passes through the buckle 203 and folds back upon itself. The adjustment region 209 may be removably attachable to itself or to the second belt portion 219. Such attachment may be accomplished by, for example, hook and loop fasteners. Varying the amount of the adjustment region 209 of the second portion 209 which is passed through the buckle 203 varies the effective overall length of the belt 205. Different users may prefer the belt 205 to be of different lengths. For example, users with greater chest circumference measurements or greater heights may require or prefer a greater effective length for the belt 205. Further, users may prefer a certain tightness of fit, so even users with identical body measurements may prefer different effective lengths for the belt 205. The shoulder strap 201 is configurable to fit a variety of users dependent on the preferences and requirements of the user.

The belt 205 comprises a first belt portion 217. The first belt portion 217 partially passes through the buckle 203 and folds back upon itself at first belt portion attachment point 207. The first belt portion 217, at first belt portion attachment point 207, is secured to itself by one or more of various methods such as, for example, hook-and-Loop fasteners, sewing, adhesive, or similar methods.

The harness 213 comprises a plurality of portions removably attached to one another by the use of, for example, hook and loop fasteners. The harness 213 is configured to retain a portion of the neck support device (not shown) against the paddle 211.

The shoulder strap 201 is utilized by positioning the paddle upon the user's shoulder, passing part of the adjustment portion 209 through the buckle 203 until the desired effective belt length is attained, ensuring the plurality of portions of the harness 213 are detached from one another, positioning the neck support device (not shown) against the paddle 211, and attaching the plurality of portions of the harness 213 to each other, thereby removably securing the neck support device (not shown) within the harness 213, which is positioned upon the user's shoulder.

Figure 3:
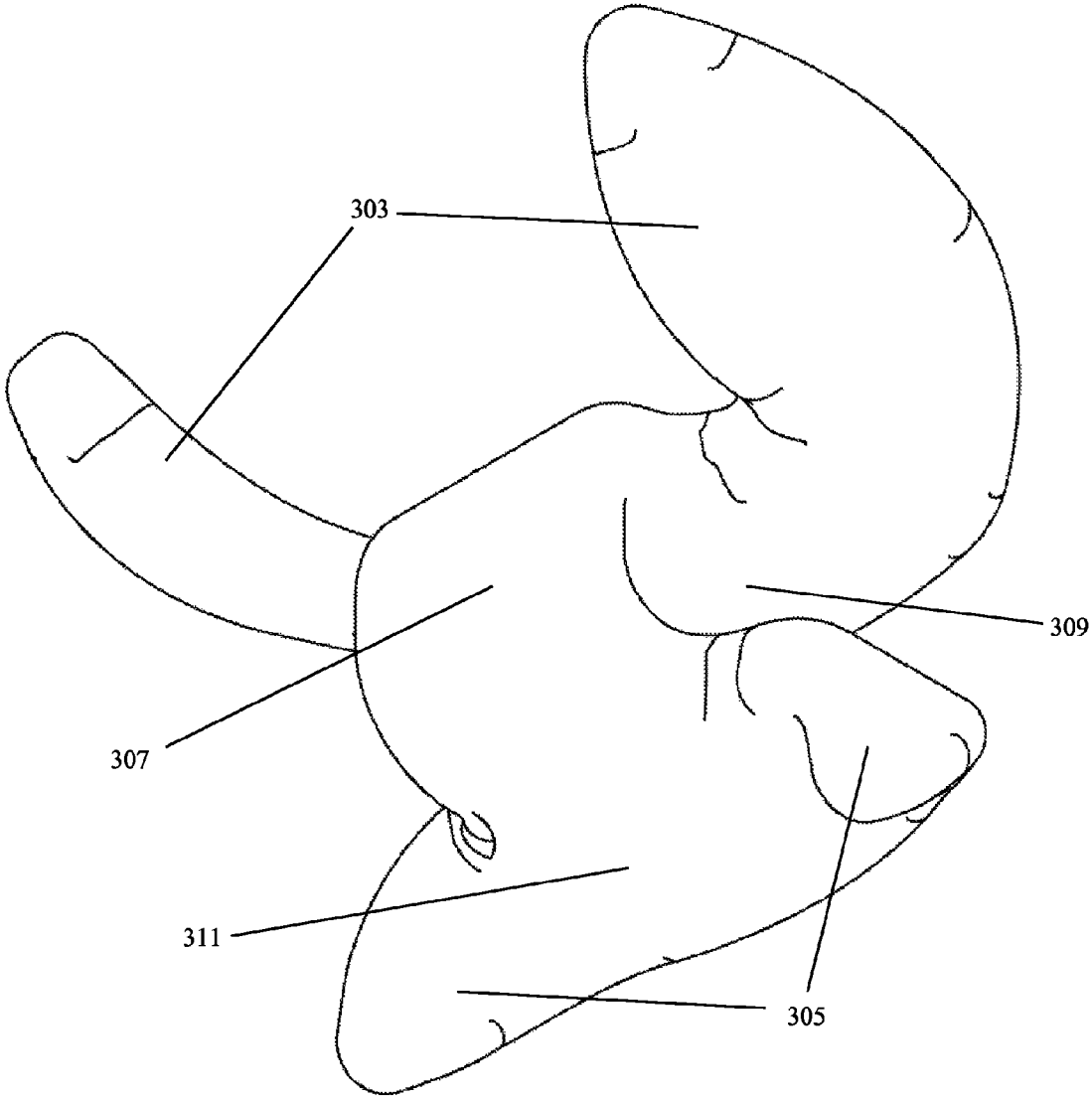
FIG. 3 is a perspective view of an embodiment of the present invention.

FIG. 3 depicts a perspective view of an aspect of the present invention. A neck support device 301 is shown in a support configuration. The neck support device 301 comprises a head portion 309, a neck portion 307, and a shoulder portion 311. The head portion 309 is attached to the neck portion 307, which, in turn, is attached to the shoulder portion 311. Thus, the head portion 309 is connected to the shoulder portion 311 via the neck portion 307. When in use, a user positions the neck portion 307 against the side of the user's neck and the shoulder portion 311 atop the user's shoulder, with the head portion 309 being positioned to provide support to the user's head when, for example, sleeping or resting.

The neck support device 301 comprises an inner core (not shown). The inner core is of similar construction to that described in connection with FIG. 1 and FIG. 2. However, in the embodiment shown in FIG. 3, the inner core is not visibly depicted as it is entirely encompassed and enclosed within the outer sheath material 313. The outer sheath may be removable from the inner core. A user may remove the outer sheath to facilitate cleaning the outer sheath or inner core, to substitute the outer sheath with a different outer sheath of different aesthetics, or to substitute the outer sheath with a different outer sheath of different material, structure, or padding distribution. Thus, the replacement outer sheath may provide additional customizability of the neck support device for the user's aesthetic preference, fit preference, comfort, or other functionality.

The shoulder portion 311 includes shoulder projections 305, each of which is foldable and bendable to the user's preference. The shoulder portion 311 is configured to rest atop the shoulder of the user. More specifically, the shoulder portion 311 may rest primarily upon the top of the user's shoulder area, while the shoulder projections 305 may rest against the front and back of the shoulder area.

The head portion 309 includes head projections 303, each of which is foldable and bendable to the user's preference. The head projections 303 and head portion 309 may be bent to the user's preference in order to provide sufficient support to the various areas of the user's head. Such various areas include areas such as, for example, the MEP, MA, MAP, and OP. The head projections 303 can be bent to provide additional support to prevent the user's head from drooping forward or backward, while the center of the head portion 309 prevent the user's head from drooping laterally to at least one side.

The outer sheath material 313 may comprise padding to provide support to various areas of the user's head. Further, the outer sheath material 313 at the head portion 309 may comprise circumaural padding, meaning padding which is circular, ellipsoid, or horse-shoe shaped to provide support the area of the user's head surrounding the ear, thereby removing pressure from the user's ear when the user's head is positioned upon or against the head portion 309.

The outer sheath material 313 may comprise any of various types of padding, foam, cloth, fabric, or other flexible material. The outer sheath material 313 encompasses the head portion 309, neck portion 307, and shoulder portion 311 of the neck support device 301. In an embodiment, the portion of the outer sheath material 313 encompassing the shoulder portion 311 comprises a gripping surface to help prevent the neck support device 301 from slipping from the shoulder of the user when the neck support device is bent into its support shape.

Figure 4:
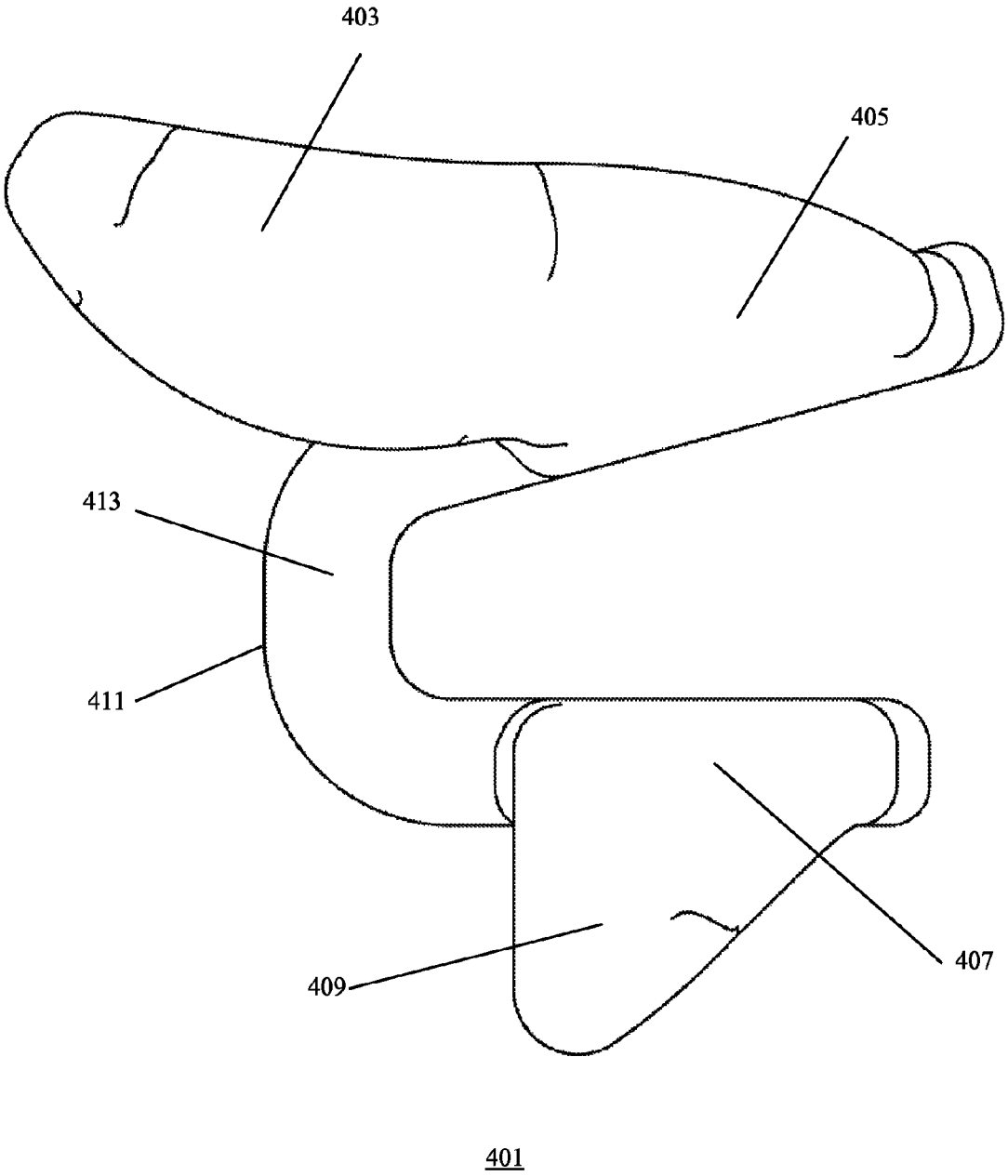
FIG. 4 is a side view of an embodiment of the present invention.

FIG. 4 depicts a side view of an aspect of the present invention. A neck support device 401 is shown in its support configuration. The neck support device 401 comprises a neck portion 413 which connects a head portion 405 to a shoulder portion 407. The head portion 405 comprises head projections 403. The shoulder portion 407 comprises shoulder projections 409. The neck portion 413 is positioned against the neck of the user at a neck contact surface 411.

The head portion 405 includes head projections 403, each of which is foldable and bendable to the user's preference. The head projections 403 and head portion 405 may be bent to the user's preference in order to provide sufficient support to the various areas of the user's head. Such various areas include areas such as, for example, the MEP, MA, MAP, and OP. The outer sheath material 415 may comprise padding to provide support to various areas of the user's head. Further, the outer sheath material 415 at the head portion 405 may comprise circumaural padding, meaning padding which is circular, ellipsoid, or horse-shoe shaped to provide support the area of the user's head surrounding the ear, thereby removing pressure from the user's ear when the user's head is positioned upon or against the head portion 405.

The outer sheath material 415 may comprise any of various types of padding, foam, cloth, fabric, or other flexible material. The outer sheath material 415 encompasses the head portion 405, neck portion 413, and shoulder portion 4070/ the neck support device 401. In an embodiment, the portion of the outer sheath material 415 encompassing the shoulder portion 407 comprises a gripping surface to help prevent the neck support device 401 from slipping from the shoulder of the user when the neck support device is bent into its support shape.

The neck support device 401 comprises an inner core (not shown). The inner core is of similar construction to that described in connection with FIG. 1 and FIG. 2. However, in the embodiment shown in FIG. 4, the inner core is not visibly depicted as it is entirely encompassed and enclosed within the outer sheath material.

Multiple neck support devices may be worn. Each of these multiple neck support devices may be used in conjunction with a shoulder strap. In this case, the shoulder straps may cross the user's chest in a crisscross fashion.

Other systems, methods, and/or products according to the above embodiments will be or will become apparent to one of ordinary skill in the art upon review of the above description, the following drawings, and any further description. It is intended that all such additional systems, methods, and/or products be included within this description, be within the scope of the present invention, and be protected by the accompanying claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A device to support the head and neck of a person comprising:

an inner core, the inner core comprising a head portion, a shoulder portion, and a neck portion each comprising user-bendable, shape-retaining material, such that the head portion, the shoulder portion, and the neck portion are each individually user-bendable and shape-retaining, such that the head portion and the neck portion are user-bendable and shape-retaining in relation to each other, and such that the shoulder portion and the neck portion are user-bendable and shape-retaining in relation to each other; and an outer sheath material at least partially encasing the inner core;

the head portion dimensioned to bear the weight of the head of the person, the weight exerting a force;

the neck portion connecting the head portion and the shoulder portion and translating the force exerted upon the head portion to the shoulder portion, the shoulder portion configured to be positioned on the shoulder of the person;

at least a portion of an edge of the head portion adjoining a first edge of the neck portion; and at least a portion of an edge of the shoulder portion adjoining a second edge of the neck portion, the second edge of the neck portion opposing the first edge of the neck portion.

2. The device of claim 1, wherein:

the inner core comprises aluminum.

3. The device of claim 2, wherein:

the aluminum is soft temper aluminum.

4. The device of claim 1, wherein:

the inner core comprises plastic.

5. The device of claim 1, wherein:

the outer sheath material of the shoulder portion comprising a gripping surface.

6. The device of claim 1, wherein:

the outer sheath material completely encasing the inner core.

7. The device of claim 1, wherein:

the outer sheath material of the head portion comprises padding.

8. The device of claim 7, wherein:

the padding is configured to be positioned adjacent the occiput, the mastoid process, the angle of the mandible, and the mentum of the person when the device is in use.

9. The device of claim 7, wherein:

the padding comprises circumaural padding, the circumaural padding having a cavity dimensioned to receive the ear of the person.

10. The device of claim 1, wherein:

the inner core flattens, reducing the profile of the device for storage.

11. The device of claim 1, further comprising:

a shoulder strap, the shoulder strap comprising:

a paddle and a harness for removably securing the shoulder portion to the paddle;

a first belt segment attached at a first end to the paddle;

a second belt segment attached at a first end to the paddle;

a second end of the first belt segment and a second end of the second belt segment adjustably secured to one another;

the first belt segment and the second belt segment configured for retaining the paddle securely against a shoulder of the person.

12. The device of claim 10, wherein:

the first belt segment and the second belt segment are adjustably secured to one another with hook and loop fasteners.

13. The device of claim 1, wherein:

the outer sheath material of the head portion comprises fleece.

14. The device of claim 1, wherein:

the outer sheath material comprises a breach dimensioned to allow passage of the inner core.

* * * * *